US008741827B2

(12) United States Patent
Vyrostko et al.

(10) Patent No.: US 8,741,827 B2
(45) Date of Patent: Jun. 3, 2014

(54) MULTI-PURPOSE CLEANER

(76) Inventors: Lucyna Vyrostko, Pittsburgh, PA (US); Joseph Vyrostko, Pittsburgh, PA (US)

( * ) Notice: Subject to any disclaimer, the term of this patent is extended or adjusted under 35 U.S.C. 154(b) by 123 days.

(21) Appl. No.: 13/400,162

(22) Filed: Feb. 20, 2012

(65) Prior Publication Data

US 2012/0214726 A1 Aug. 23, 2012

Related U.S. Application Data

(60) Provisional application No. 61/444,840, filed on Feb. 21, 2011.

(51) Int. Cl.

| | |
|---|---|
| ***C11D 1/00*** | (2006.01) |
| ***C11D 3/20*** | (2006.01) |
| ***C11D 3/30*** | (2006.01) |
| ***C11D 3/43*** | (2006.01) |

(52) U.S. Cl.

USPC ..... 510/238; 510/101; 510/235; 510/421; 510/422; 510/426; 510/435; 510/488; 510/505; 510/499

(58) Field of Classification Search

USPC ..... 510/101, 235, 238, 421, 422, 426, 435, 510/488, 505, 499

See application file for complete search history.

(56) References Cited

U.S. PATENT DOCUMENTS

| | | | | |
|---|---|---|---|---|
| 4,181,623 | A | 1/1980 | Dillarstone et al. | |
| 5,849,681 | A * | 12/1998 | Neumiller et al. | 510/182 |
| 6,432,892 | B2 * | 8/2002 | Meine et al. | 510/111 |
| 2001/0056047 | A1 * | 12/2001 | Meine et al. | 510/111 |
| 2004/0121927 | A1 * | 6/2004 | McDonald | 510/245 |
| 2005/0245424 | A1 * | 11/2005 | Patel et al. | 510/439 |
| 2006/0293202 | A1 * | 12/2006 | Cate et al. | 510/235 |
| 2007/0191252 | A1 * | 8/2007 | Kilkenny et al. | 510/424 |
| 2008/0045441 | A1 * | 2/2008 | Schmiedel et al. | 510/514 |
| 2008/0095828 | A1 * | 4/2008 | Privitera et al. | 424/443 |
| 2009/0035228 | A1 * | 2/2009 | Modak et al. | 424/49 |
| 2010/0062966 | A1 * | 3/2010 | Lincoln et al. | 510/466 |
| 2011/0146709 | A1 * | 6/2011 | Toussaint et al. | 134/6 |

* cited by examiner

*Primary Examiner* — Gregory R Delcotto
(74) *Attorney, Agent, or Firm* — James Ray & Assoc

(57) ABSTRACT

A multi-purpose cleaning compound comprising about 4.50% to about 16.50% by volume isopropyl alcohol; about 4.50% to about 16.50% by volume vinegar; about 2.00% and about 8.50% by volume ammonia; about 2.00% by volume of at least one pre-selected surfactant; between about 0.009% and about 0.05% by volume rosemary oil; and about 56.50% and about 86.90% by volume water.

4 Claims, No Drawings

MULTI-PURPOSE CLEANER

CROSS REFERENCE TO RELATED APPLICATION

This application is related to and claims priority from U.S. Provisional Patent application having Ser. No. 61/444,840 filed on Feb. 21, 2011.

FIELD OF THE INVENTION

The present invention relates, in general, to cleaning products and, more particularly, this invention relates to an aqueous cleaning solution which can be used on a variety of different surfaces for a large number of cleaning applications.

BACKGROUND OF THE INVENTION

Prior to the conception and development of the instant invention, as is well documented in the prior art, there are numerous cleaning products commercially available on the market at the present time.

However, as is equally well known in the prior art, these particular products can generally only be used in a limited number of cleaning applications. This limited use, therefore, requires the purchase and storing of a number of different products to handle the numerous cleaning applications encountered in everyday cleaning of different apartments in apartment houses, private homes, hotel rooms and offices.

For example, some products are for cleaning glass, others for cleaning carpeting, tile, hardwood floors, upholstery (either fabric or leather), ovens, and metal. Other products on the other hand are required, for example, to remove stains from clothing and other different type fabrics, mold and mildew from showers and basement walls and floors.

Additionally, when it becomes necessary to clean rooms that are located on different floors of a structure it is oftentimes the case where the particular thing, or type of surface, to be cleaned may require a cleaning product that has been inadvertently left on a different floor. This obviously will result in either a lot of time and energy being wasted, or in an inferior cleaning job being accomplished.

SUMMARY OF THE INVENTION

According to a first aspect, the present invention provides a multi-purpose cleaning compound comprising between about 4.50% to about 16.50% by volume isopropyl alcohol, and between about 4.50% to about 16.50% by volume vinegar, and between about 2.00% and about 8.50% by volume ammonia, and about 2.00% by volume of at least one preselected surfactant, and between about 0.009% and about 0.05% by volume rosemary oil and between about 56.50% and about 86.90% by volume of water.

According to a second aspect, the present invention provides a multi-purpose cleaning compound concentrate to be mixed with water. The multi-purpose cleaning compound concentrate comprising between about 37.90% to about 40.85% by volume isopropyl alcohol, and between about 37.90% to about 40.85% by volume vinegar, and between about 4.60% and about 19.50% by volume ammonia, and between about .10% and about 4.60% by volume of at least one pre-selected surfactant, and between about 0.05% and about 0.10% by volume rosemary oil.

OBJECTS OF THE INVENTION

It is, therefore, one of the primary objects of the present invention to provide a cleaning solution which has multiple uses.

Another object of the present invention is to provide a cleaning solution which can be used on a plurality of different surfaces including wood, fabric, glass, metal, linoleum, tile, plastic, carpet, ceramic and clothing.

Still another object of the present invention is to provide a cleaning solution which will minimize the number of products required to clean different surfaces.

Yet another object of the present invention is to provide a cleaning solution which will reduce the storage space requirements.

A further object of the present invention is to provide a cleaning solution which will save time and energy for the person doing the cleaning.

Still yet another object of the present invention is to provide a cleaning solution which is economical to produce.

A still further object of the present invention is to provide a cleaning solution which has a pleasant aroma.

It is another object of the present invention to provide a cleaning solution which is effective in removing mold and mildew.

Another object of the present invention is to provide a cleaning solution that can be used on all automotive surfaces, such as car exteriors, interior upholstery and tires without damages.

Still another object of the present invention is to provide an environmentally friendly all purpose cleaning solution for use both indoors and outdoors.

Yet still another object of the present invention to provide a cleaning solution which can be supplied as either a ready to use mixture or as a concentrate to be mixed with a predetermined amount of water.

In addition to the various objects and advantages of the present invention which have been described with some degree of specificity above it should be obvious that additional objects and advantages of the present invention will become more readily apparent to those persons who are skilled in the relevant art from the following more detailed description of the invention, particularly, when such description is taken in conjunction with the appended claims.

BRIEF DESCRIPTION OF A PRESENTLY PREFERRED AND VARIOUS ALTERNATIVE EMBODIMENTS OF THE INVENTION

As mention above the present invention can be commercially produced as either a concentrated solution that should be diluted with water before use or as a ready to use solution that can be used straight from the product's container.

In one presently preferred embodiment, of the instant invention, the ready to use multi-purpose cleaning compound comprises between about 4.50% to about 16.50% by volume isopropyl alcohol, and between about 4.50% to about 16.50% by volume vinegar, and between about 2.00% and about 8.50% by volume ammonia, and about 2.00% by volume of at least one pre-selected surfactant, and between about 0.009% and about 0.05% by volume rosemary oil and between about 56.50% and about 86.90% by volume of water.

It is presently preferred that the vinegar be white vinegar and the ammonia be lemon ammonia to reduce the smell of the solution.

Also, in the presently preferred embodiment, a given amount of the aqueous solution contains about 4.50% to 16.50% of 70% isopropyl alcohol solution, about 4.50% to 16.50% of white vinegar, about 2% to 8.5% of 5- 10% ammonia solution, about 0.001% to 2.00% of at least one surfactant, and about 0.009% to 0.05% rosemary essential oil.

In yet another presently preferred embodiment, a given amount of the aqueous solution contains about 7.50% to 9.50% of isopropyl alcohol, about 7.50% to 9.50% of white vinegar, about 3% to 5.5% of lemon ammonia, about0.005% to 2.00% of at least one surfactant, and about 0.01% to 0.03% rosemary essential oil.

In still yet another presently preferred embodiment, a given amount of the aqueous solution contains about 7.50% to 9.50% of 70% isopropyl alcohol solution, about 7.50% to 9.50% of white vinegar, about 3% to 5.5% of 5-10% lemon ammonia solution, about 0.005% to 2.00% of at least one surfactant, and about 0.01% to 0.03% rosemary essential oil.

In yet another presently preferred embodiment, a given amount of the aqueous solution contains about 8.33% of isopropyl alcohol, about 8.33% of white vinegar, about 4.168% of lemon ammonia, about 0.174% of dish soap, and about 0.018% rosemary essential oil.

In yet another preferred embodiment, a given amount of the aqueous solution contains about 8.33% of 70% isopropyl alcohol solution, about 8.33% of white vinegar, about 4.168% of 5-10% lemon ammonia solution, about 0.174% of dish soap, and about 0.018% rosemary essential oil.

Preferably, the isopropyl alcohol is present in the compound in an amount of between about 8.25% to about 8.50%. The white vinegar is present in the compound in an amount of between about 8.25% to about 8.50%. The lemon ammonia is present in the compound in an amount of between about 4.00% and 4.75%. The liquid dish soap is present in the compound in an amount of between about 1.00% and 2.00% and the rosemary oil is present in the compound in an amount of between about 0.01% to about 0.03%.

In another embodiment of the invention, the present invention provides a multi-purpose cleaning compound concentrate to be mixed with water. The multi-purpose cleaning compound concentrate comprising between about 37.90% to about 40.85% by volume isopropyl alcohol, and between about 37.90% to about 40.85% by volume vinegar, and between about 4.60% and about 19.50% by volume ammonia, and between about .10% and about 4.60% by volume of at least one pre-selected surfactant, and between about 0.05% and about 0.10% by volume rosemary oil.

It is presently preferred that the isopropyl alcohol be a 70.0% solution. It is also presently preferred that the vinegar is a white vinegar. Further, is presently preferred that the ammonia is a lemon ammonia and is of a 5.0 to 10.0% solution. Finally, it is presently preferred that the surfactant is liquid dish soap.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

We claim:

1. A multi-purpose cleaning composition, said cleaning composition comprising:

(a) about 7.5% to volume isopropyl alcohol;

(b) about 12.0% to about 16.50% by volume vinegar;

(c) about about 8.50% by volume ammonia;

(d) about 2.00% by volume of at least one pre-selected surfactant;

(e) between about 0.009% and about 0.05% by volume rosemary oil; and (f) about 56.50% and about 86.90% by volume of water.

2. A multi-purpose cleaning composition concentrate to be mixed with water, said multi-purpose cleaning compound concentrate comprising between about 37.90% to about 40.85% by volume isopropyl alcohol, between about 37.90% to about 40.85% by volume vinegar, between about 4.60% and about 19.50% by volume ammonia, between about 0.1% and about 4.60% by volume of at least one pre-selected surfactant, and between about 0.05% and about 0.10% by volume rosemary oil.

3. A multi-purpose cleaning composition, according to claim 2, wherein said vinegar is white vinegar.

4. A multi-purpose cleaning composition, according to claim 2, wherein said ammonia is lemon ammonia.

* * * * *